United States Patent [19]

Yang

[11] Patent Number: 4,647,028

[45] Date of Patent: Mar. 3, 1987

[54] VERSATILE CLAMPING ASSEMBLY FOR WORKBENCH OR THE LIKE

[76] Inventor: Tai-Her Yang, 5-1 Taipin St., Si-Hu Town, Dzan-Hwa, Taiwan, Taiwan

[21] Appl. No.: 766,971

[22] Filed: Aug. 19, 1985

[51] Int. Cl.[4] ..... B25B 1/00

[52] U.S. Cl. ..... 269/139; 269/152; 269/164; 269/155; 269/219; 269/258

[58] Field of Search ..... 269/152, 154, 155, 258, 269/244, 219, 221, 139, 164

[56] References Cited

U.S. PATENT DOCUMENTS

| | | | |
|---|---|---|---|
| 368,278 | 8/1887 | Cheney | 269/221 |
| 807,788 | 12/1905 | Stetler | 269/139 |
| 2,322,380 | 6/1943 | Mosley | 269/164 |
| 2,594,794 | 4/1952 | Mull | 269/219 |
| 3,977,662 | 8/1976 | Cook | 269/152 |
| 4,527,786 | 7/1985 | Hsu | 269/155 |

FOREIGN PATENT DOCUMENTS

| | | | |
|---|---|---|---|
| 128619 | 1/1879 | France | 269/219 |

*Primary Examiner*—Robert C. Watson
*Attorney, Agent, or Firm*—Leonard Bloom

[57] ABSTRACT

A pair of clamp claw assemblies are mounted on the frame of a workbench. At least one clamp claw assembly is movable in a substantially horizontal plane laterally of the workbench and in a direction towards and away from the other clamp claw assembly. Each clamp claw assembly has a pair of substantially parallel threaded rods rotatably mounted on the frame. A pair of threaded blocks are carried on the rods, and a clamp claw is pivotably mounted about a substantially vertical axis on each block, such that the clamp claws are pivotably independently of one another. In a preferred embodiment, four clamp claws are provided; and the threaded rods have respective handles disposed on the same side of the workbench frame.

3 Claims, 14 Drawing Figures

VERSATILE CLAMPING ASSEMBLY FOR WORKBENCH OR THE LIKE

BACKGROUND OF THE INVENTION

This application is an improved case of the U.S. Pat. No. 2,322,380 to the effect that four groups of the rotatable clamp claws are to maximize its clamping capability to clamp various work pieces in different shapes, hereby facilitating the work process and also to provide a design for the same-side operation to expedite the operator's operations.

SUMMARY OF THE INVENTION

As to the 1st and 2nd clamp groups with opposite clamping functions, a separate drive screw is provided on each of the clamp claws on respective said clamp groups, respectively but their clamp claw sets are fixed and not rotatable, therefore in different shapes the work pieces to which they are applicable are very limited, and although the improved case utility model No. 19412 of the above-said U.S. Pat. No. 2,322,380 has disclosed two groups of their clamp claws are rotatable, the other two groups of them are not rotatable, thus making their applicable scope still limited, especially for the butt joint of the work pieces in irregular shapes (please see Enclosure 1), which forms a dead angle in their functions, i.e. the above-said two cases are still considered incomplete, therefore this case is an improved design in response to the afore-cited defects.

BRIEF DESCRIPTION OF THE DRAWINGS

FIGS. 1—1 is a cross sectional view of the line A—A in FIG. 1.

FIGS. 1-2 is a cross sectional view of the line B—B in FIG. 1.

FIGS. 1-3 is a tri-dimensional view of FIG. 1.

FIG. 2 shows the examplary embodiment of the guide screws with a large handle and a small handle on the same operating side of the work bench illustrated in FIG. 1.

FIG. 3 shows the examplary embodiment of the work bench with a handle provided on each of its two sides respectively as illustrated in FIG. 1.

DETAILED DESCRIPTION OF THE INVENTION

To quest for a simple clamp with perfect functions for clamping the work pieces is our demand, especially for a long time various types of the work benches have been designed, for instance, in the U.S. Pat. No. 2,322,380 in which, two groups of the 1st and 2nd clamp groups with opposite clamping functions are provided on the machine frame, and the structure of a separate driving screw is provided on each of the clamp claws of various said clamp groups respectively.

Hence, to provide a device to a clamp a number of places of the work pieces and to clamp the respective two work pieces separately at opposite butt joint positions (mostly for gluing the wooden work piecws) has become possible.

But, obviously since the U.S. Pat. No. 2,322,380 does not have any rotatable clamp claws make it rotate along with the outer shape of a work piece to effect a good clamping of the work piece, therefore, its objects only limited to the parallel work pieces, thereby forming inconveniences of work, however although the R.O.C. PAT. NO. 19412 has improved the above-said case by having two groups of the clamp claws by having two groups of the clamp claws rotatable, the other two groups of them are still not rotatable, thereby forming many defects, for example it can not make any even clamp for a fixed opposite round periphery, and when it clamps the two opposite work pieces for a butt joint (such as the furniture or articraft) it is impossible to adjust the relative positions of the two work pieces, consequently, the defects of the above-cited two cases maybe verified from checking the examplary embodiments in reference drawing FIGS. 6-11 which show the use of selected irregularly shaped workpieces with an embodiment of the invention and the above-mentioned two prior art devices.

Figure 1:
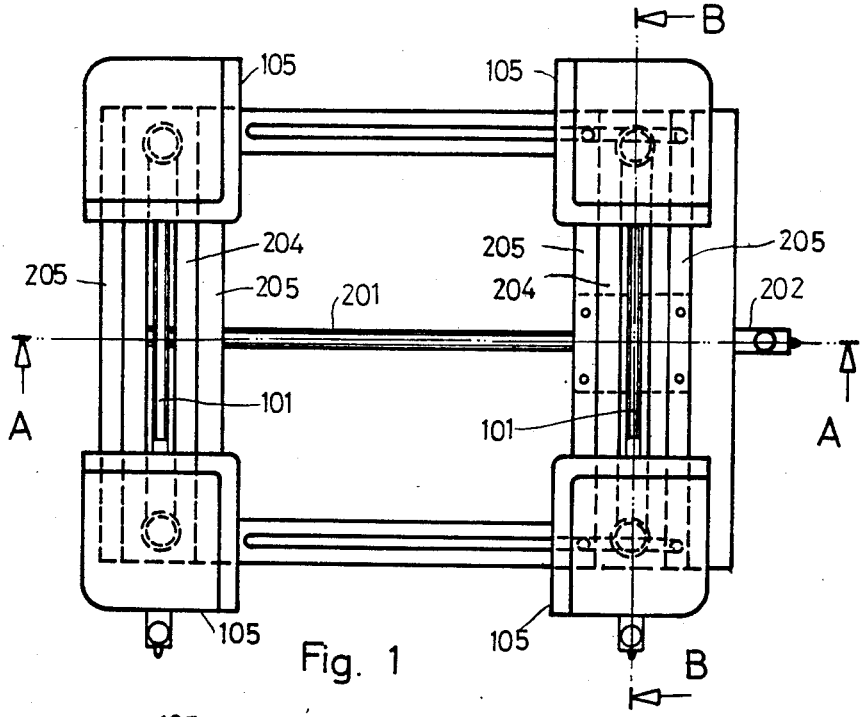
FIG. 1 shows view of the examplary embodiments of the two sets of the rotatable clamp claws forming the first clamp group and another two sets of the rotatable clamp claws forming the second clamp group, and each of clamp claw sets has mutually driving guides screws and the commonly used handle bar that is separately driven into motion and installed on the same side of each of various clamp claws respectively.
Figure 1:
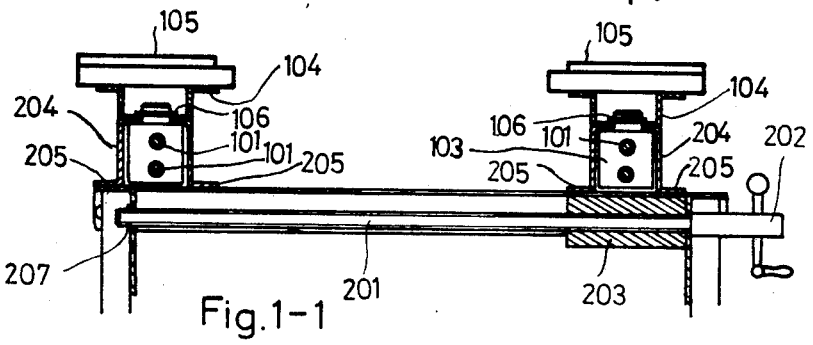

In this invention, the design is to improve the defects of the above-said two cases and to make a break through over its functional dead angle. FIG. 1 is an examplary embodiment. From the structural example disclosed in FIG. 1, the operating handle bar is to respectively drive the guide screw 101 which, in turn, drives its pivotal shaft 103 into motion to drive the clamping or releasing actions of the holder seat 104 and clamp claw 105, the clamp claw 105 is provided on the holder seat 104, the middle part of the holder seat 104 has a round hole for rotatabely coupling the pivotal shaft 103 which is then positioned by a snap ring 106.

The handle bar 202 of the drive guide screw 201 drives the first and second clamp groups, one end of the guide screw 201 is coupled by a positioning pin 207 to one side of the machine pivot, the third clamp group having a coupling nut 203 is provided on one side or two sides of the bottom frame 205 of the clamp seat of the second clamp group, when the guide screw 201 is driven into motion, it drives the second clamp group into motion, hereby conducting the movements to tightly clamp or release the first clamp group.

Since all the fours groups of clamp claws are rotatable, this has a further advantage in the applications to clamping the work pieces and functions in comparison to the U.S. Pat. No. 2,322,320. Please refer to the reference FIGS. A, B, C, D, E And F. We may discover it is particularly effective to the butt joint of the two opposite work pieces in irregular shapes, while this butt joint is often used in the carved handicraft or DIY carpenter work, therefore this design is very useful.

FIGS. 1—1 is a cross sectional view of line A—A in FIG. 1.

Figures 1, 2:
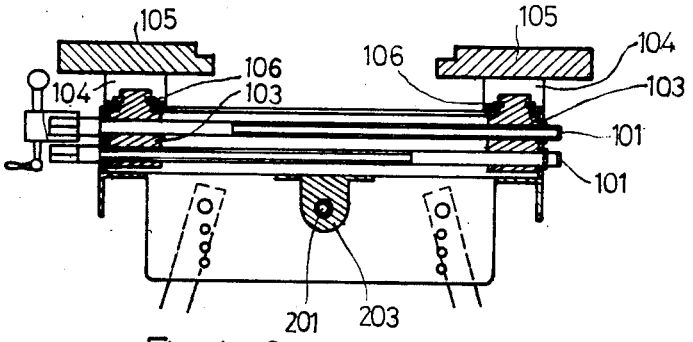

FIGS. 1-2 is a cross sectional view of line B—B in FIG. 1.

Figures 1, 2, 3:
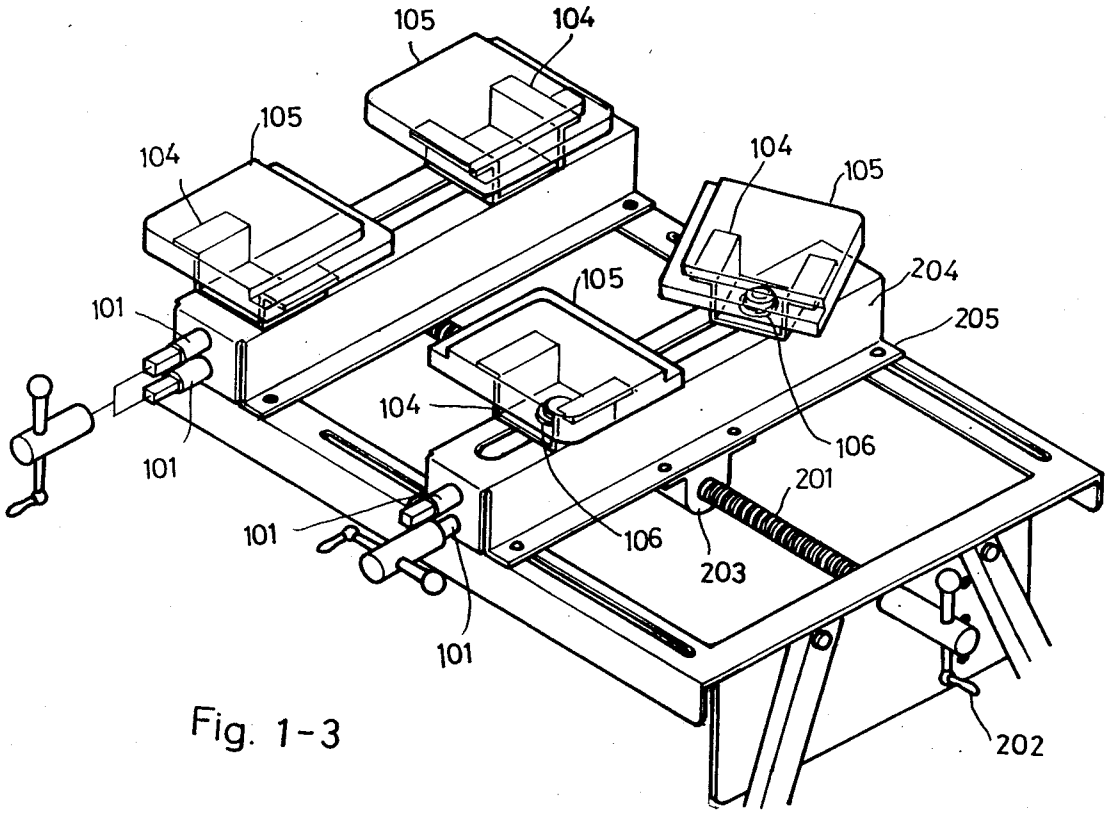
Figure 3:
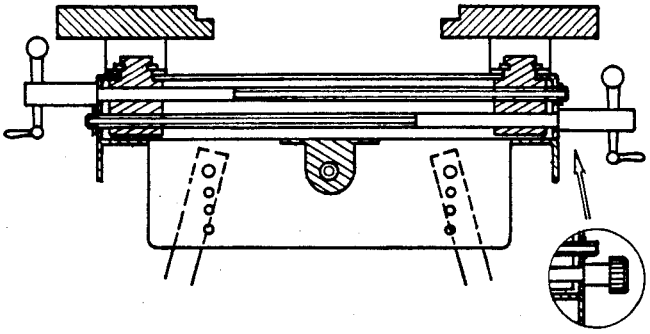
Figure 2:
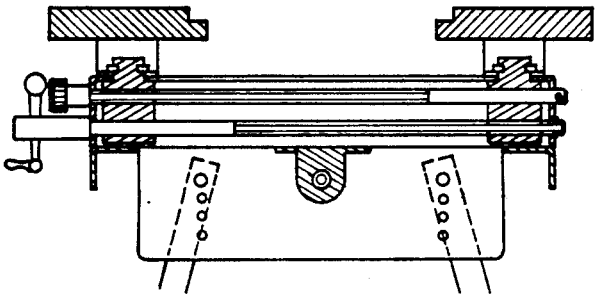

FIGS. 1-3 is a tri-dimensional view of FIG. 1.

FIG. 2 is the examplary embodiment of a large handle and a small handle provided on the guide screw on the operating side, in which the small handle operates the clamp claw that provides the base position, so before a work piece is clamped thereon, the position of the clamp claw that the large handle drives into motion is adjusted at first to a proper place to serve as a base position, while the handle bar with a larger dismeter is to drive another group of clamp claws into motion to clamp the work pieces in a powerful clamping action.

FIG. 3 shows what is disclosed in the design of this case, i.e. the examplary embodiment of the operating handle bars for various clamp claws shown in FIG. 1 are respectively provided on both sides of the work bench. They serve as the reference examplary embodiments, in which the handle bar on one side can be a small handle bar with a smaller rotatable diameter to adjust, before clamping the work pieces, the position of a group of the clamp claws to serve as a base position.

Figure 4:
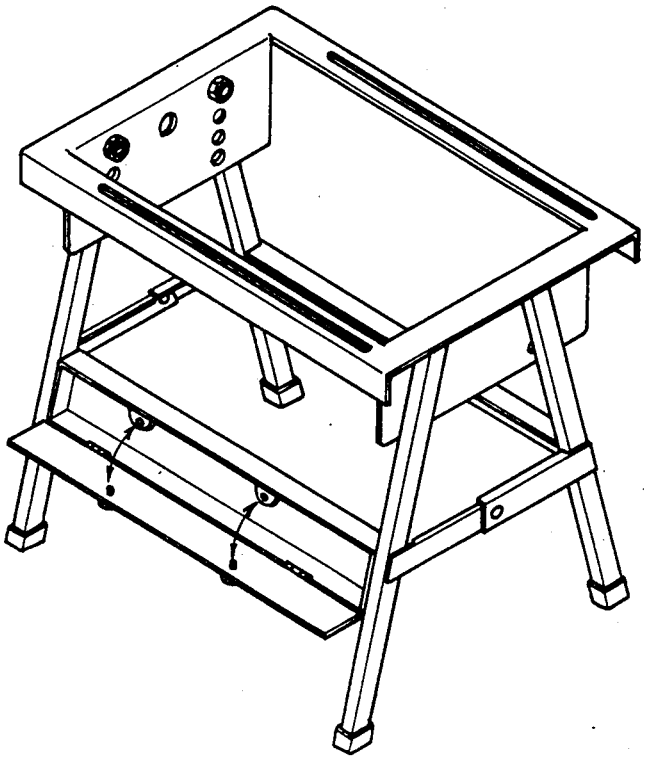

Besides, FIG. 4 is a examplary drawing of design of the above-said clamp work bench with the height of its bench body adjustable, each of the two sides of its machine frame has a frame side plane extending downward respectively, holes are provided in each of the said frame side planes respectively for locking the foot mouts such holes are in a multi-hole-type vertical array for selecting the proper height of the machine frrame box-type frame is further provided between the foot mount structure and also as a tool box to accommodate tools placed therein.

Figure 5:
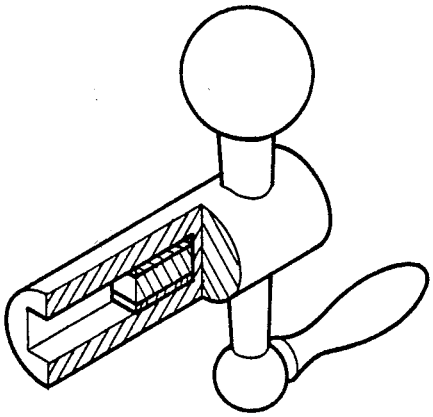
Figure 6:
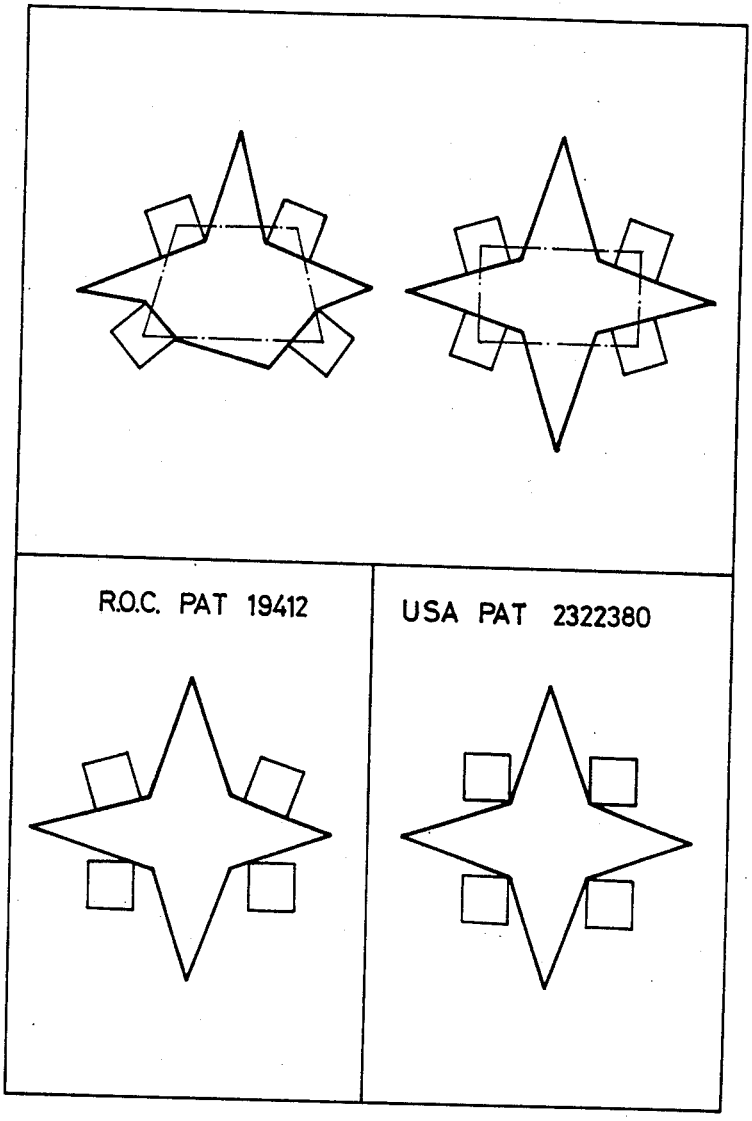
FIGS. 6-11 show the use of selected irregularly shaped workpieces with an embodiment of the invention and two prior art devices.
Figure 7:
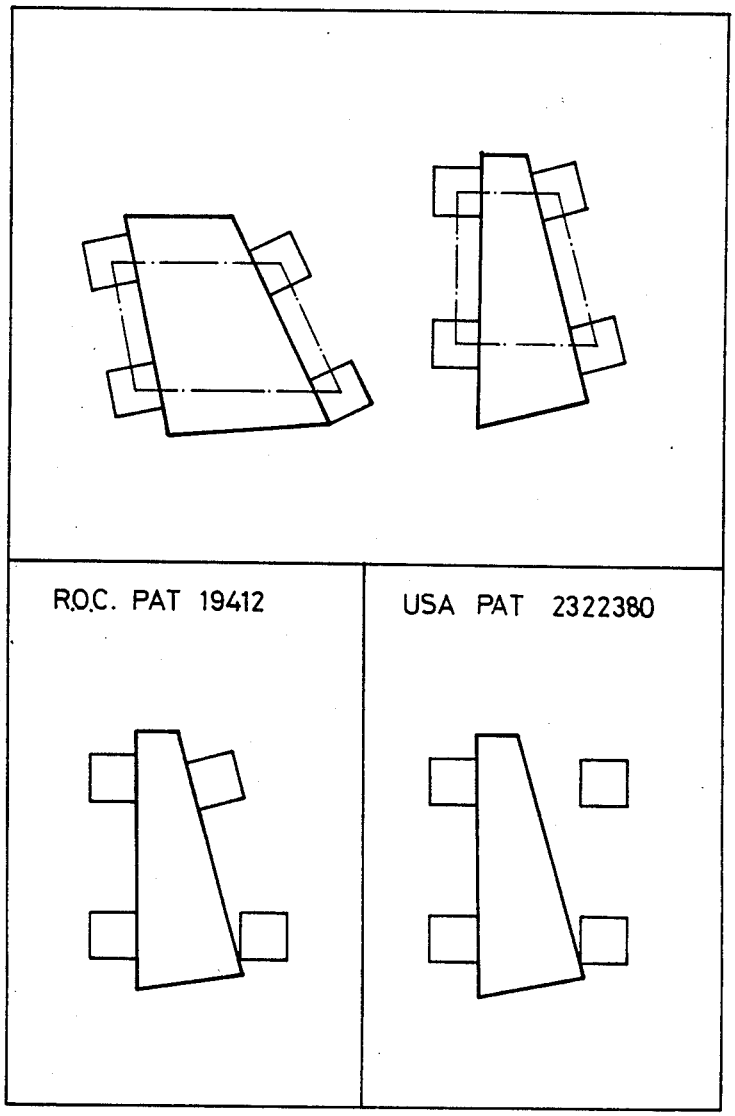
Figure 8:
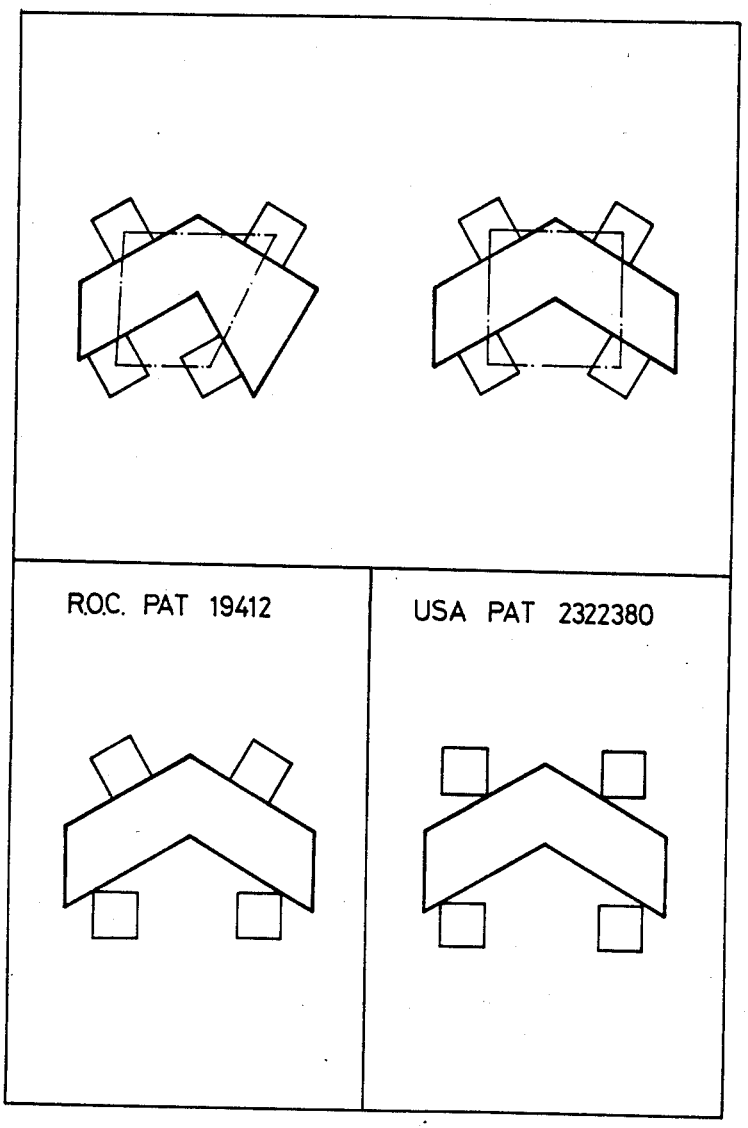
Figure 9:
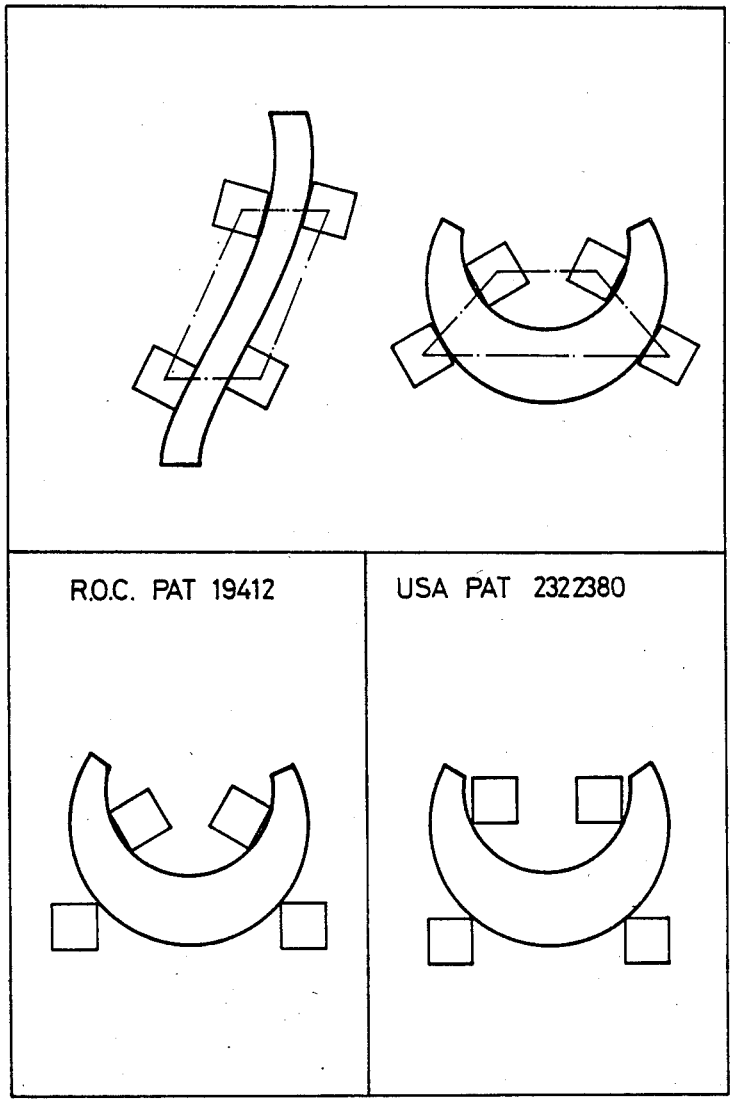
Figure 10:
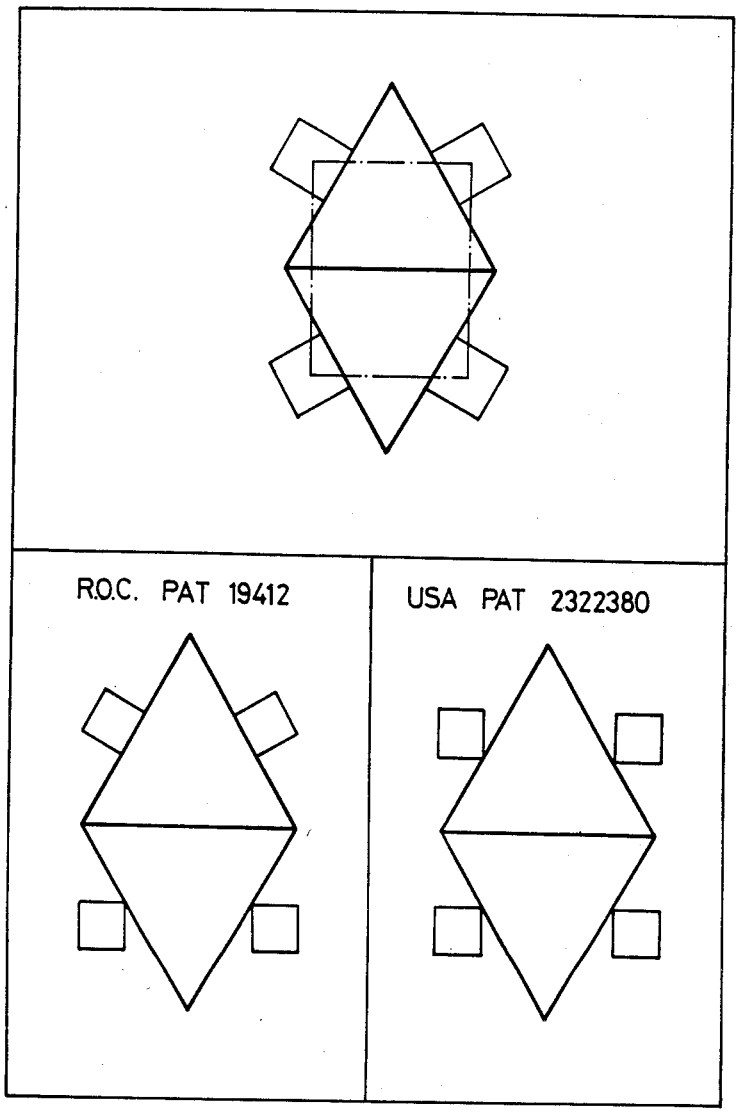
Figure 11:
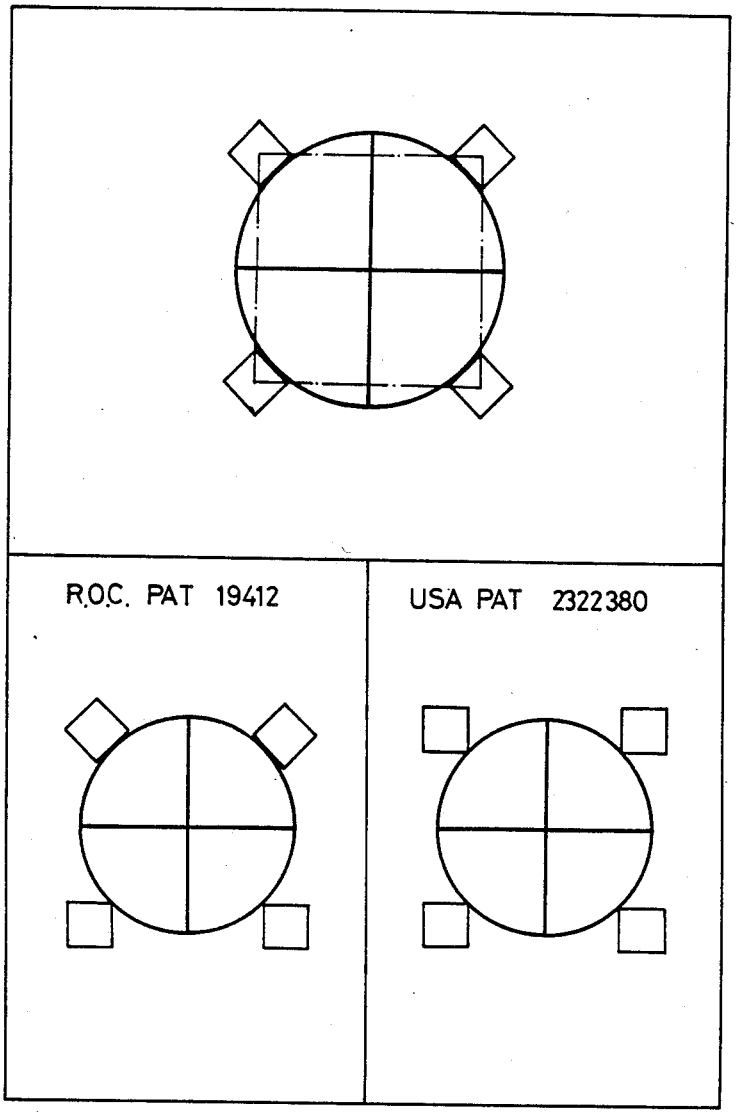

Additionally, FIG. 5 shows a handle structure joined by the attraction of the magnetic force; its main feature is that permament magnet is set in the inner part of the handle facing the coupling hole, thus forming an disrupted magnetic circuit, when the handle containing the said magnet is placed into the end of guide pipe made of a magnetic conductive material, thereby forming, with the end of the guide screw, a closed magnetic circuit and then making the handle and the end of the guide pipe and screw having a stable attractive force to prevent the handle from getting loose and off therefrom, and in the examplary embodiment shown in FIG. 1, if the operator wants take off the handle, he only needs to slightly use a small force to remove it therefrom.

This design can replace the mechanical stable structure having spring, steel beads and opposite concave slots.

Summing all the above up, in this case, the structural design provides a clamp work bench with complete functions to effectively improve the incompleteness of the functions for the above-said U.S. Pat. No. 2,322,380 and its improved model No. Tai-Tsang Hsin-Hsing (Utility Model) 19412, and therefore is undoubtedly very practical in its functions.

I claim:

1. In a workbench having a frame, the combination of a pair of clamp claw assemblies mounted on the frame, means for moving at least one of the clamp claw assemblies in a substantially horizontal plane laterally of the workbench and in a direction towards and away from the other clamp claw assembly, said one clamp claw assembly comprising a pair of substantially parallel threaded rods rotatably mounted in the frame, a pair of threaded blocks carried by the threaded rods, respectively, a clamp claw pivotably mounted about a substantially vertical axis on each block above the frame of the workbench, and a respective handle for each of the rods, whereby each of the clamp claws may be moved independently in a direction towards and away from each other and in a substantially horizontal plane transverse to the direction of lateral movement of said one clamp claw assembly, wherein each clamp claw assembly includes a clamp claw pivotably mounted about a substantially vertical axis, whereby four clamp claws are provided and are pivotable independently of one another about respective vertical axes, and wherein the rod handles are disposed on the same side of the workbench frame.

2. The combination of claim 1, wherein the rod handles have different diameters and wherein the rods are of different lengths.

3. In a workbench having a frame, the combination of a pair of clamp claw assemblies mounted on the frame, means for moving at least one of the clamp claw assemblies in a substantially horizontal plane laterally of the workbench and in a direction towards and away from the other clamp claw assembly, each clamp claw assembly comprising a pair of substantially parallel threaded rods rotatably mounted in the frame, a pair of threaded blocks carried by the threaded rods, respectively, a clamp claw pivotably mounted about a substantially vertical axis on each block above the frame of the workbench, whereby the clamp claws are pivotable independently of one another about respective vertical axes, and a respective handle for each of the rods, whereby each of the clamp claws may be moved independently in a direction towards and away from each other in a substantially horizontal plane transverse to the direction of lateral movement of said one clamp claw assembly, and each of the rod handles being of a different diameter and further being disposed on the same side of the workbench frame.

* * * * *